United States Patent [19]

Allsopp et al.

[11] Patent Number: 5,061,138

[45] Date of Patent: Oct. 29, 1991

[54] SYSTEM COVER BREAKER

[75] Inventors: Mary F. Allsopp, Glen Ellyn; Gunnar Auksi, Palatine, both of Ill.

[73] Assignee: R. R. Donnelley & Sons Company, Chicago, Ill.

[21] Appl. No.: 530,465

[22] Filed: May 29, 1990

Related U.S. Application Data

[63] Continuation of Ser. No. 295,575, Jan. 11, 1989, abandoned.

[51] Int. Cl.[5] ..... B42C 11/00

[52] U.S. Cl. ..... 412/4; 412/11; 412/22

[58] Field of Search ..... 412/11, 22, 4, 5

[56] References Cited

U.S. PATENT DOCUMENTS 2,969,554 1/1961 McCahon ..... 412/11
3,928,119 12/1975 Sarring ..... 412/11 X
4,153,963 5/1979 Hawkes et al. ..... 412/22 X
4,767,250 8/1988 Garlichs ..... 412/11

*Primary Examiner*—Frank T. Yost
*Assistant Examiner*—Eugenia A. Jones
*Attorney, Agent, or Firm*—Wood, Phillips, Mason, Recktenwald & VanSanten

[57] ABSTRACT

In a flat gathering binding system it is necessary to use a cover breaker to apply pressure to the book and cover to form a sharp square fold on each side. A cover breaker control system includes a motor which is coupled to a cover breaker carriage for varying the relative position of first and second movable cover breaker plates which are used to apply the pressure. A controller calculates the difference between book thickness which the plates are set for and a desired thickness, and is operable to vary the relative positioning by a distance corresponding to this difference so that when the plates are driven to break the cover they are spaced a distance apart according to the desired thickness.

12 Claims, 5 Drawing Sheets

SYSTEM COVER BREAKER

This applications is a continuation of application Ser. No. 295,575, filed Jan. 11, 1989, now abandoned.

FIELD OF THE INVENTION

This invention relates generally to a selective flat gathering system and more particularly to a variable cover breaker therefor.

BACKGROUND OF THE INVENTION

In a conventional bindery line, signatures to be included in a book are selected and gathered. In one form, known as perfect or square-back binding, the gathered signatures are stacked on a conveyor. A flat cover sheet is placed around the gathered signatures and parallel creases or breaks are formed in the cover sheet to provide a square backbone. The distance between the breaks is determined by the thickness of the gathered signatures.

One known apparatus for forming such breaks is a cover breaker. The cover breaker includes a pair of spaced, planer movable plates. Specifically, the plates are reciprocally movable a preselected, fixed distance. When a covered and gathered signature, as discussed above, is positioned at the cover breaker, the plates move towards one another to flatten the cover sheet against the outermost signatures to break the cover, i.e, form the creases, and provide the square backbone.

With such a known cover breaker, the relative spacing between the plates can be manually adjusted according to the thickness of the gathered signatures. Specifically, a hand wheel is turned to adjust the relative positioning of the plates. Such a cover breaker operates satisfactorily in applications where a constant thickness is required over extended periods of time. However, such a cover breaker does not lend itself to more automated flat gathering systems wherein the thickness of any two consecutive books may be different. For example, with certain magazines or catalogs, different signatures, or more or less signatures, may be included according to the intended recipient.

The present invention is intended to overcome these and other problems associated with cover breakers.

SUMMARY OF THE INVENTION

It is an object of the present invention to provide a cover breaker which automatically varies the spacing between the breaks in a cover.

Specifically, a control system is provided in a binding system operable to adhere a cover to a plurality of gathered signatures. The binding system includes a cover breaker having first and second plates movable relative to one another between a neutral position and an actuated position to provide a square backbone. The control system includes an actuator means coupled to one of the plates for varying the relative position of the plates. First and second means are provided for determining the actual relative position of the plates and a desired relative position of the plates. Control means are coupled to the actuator means and are responsive to the first and second developing means for automatically operating the actuator means to vary the relative position of the plates according to the actual relative position and the desired relative position.

A preferred application for this invention is in an automated selective flat gathering system which may include a variable number of signatures, or variable thickness signatures in consecutive gathered signatures to be bound.

In a preferred embodiment, the cover breaker control system includes a motor having a rotatable output shaft which is linked to one of the breaker plates for varying the relative position of the breaker plates responsive to movement of the shaft. A proximity sensor determines when a breaking action needs to be performed. The controller stores a value representing current thickness which the plates are set for and obtains a store value from a lookup table representing the thickness of the next gathered signatures. A controller is operable to calculate the difference between the current thickness and the desired thickness, and to operate the motor to vary the relative position of the breaker plates by an amount determined by such difference.

In one embodiment of the invention, the controller is operable to move the motor only if the difference between the actual relative position and the desired relative position is greater than a preselected minimum value.

These and other features of the present invention will be more readily apparent with reference to the drawing and the specification.

DESCRIPTION OF THE PREFERRED EMBODIMENT

Figure 1:
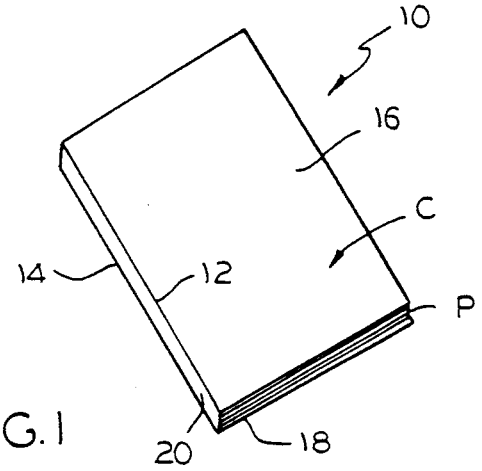
FIG. 1 is a perspective view of a book having a square backbone formed using a cover breaker according to the invention.

Referring to FIG. 1, there is illustrated a book 10 having a cover C and a plurality of pages P therein. Particularly, the cover C comprises a single elongated sheet having parallel crease or fold lines 12 and 14 providing a perfect or square-back cover with the crease lines forming right angles. Particularly, the cover sheet C includes a front cover 16, a back cover 18, and a backbone 20 between the crease lines 12 and 14.

Although not shown, the pages P comprise a plurality of signatures. As is well know, a signature comprises a plurality of sheets folded along a center line. For example, with the use of five sheets folded as such, a resulting signature includes twenty pages.

The book 10 may include any number of signatures, with each signature being of any selected thickness, as necessary or desired.

With such a book 10, the signatures are stacked together in a process known as selective flat gathering, to provide gathered signatures G. In the gathering process the signatures are stacked so that the backbones of each signature are adjacent one another. A cover sheet C is formed about the gathered signatures G, as discussed more specifically below.

Figure 2:
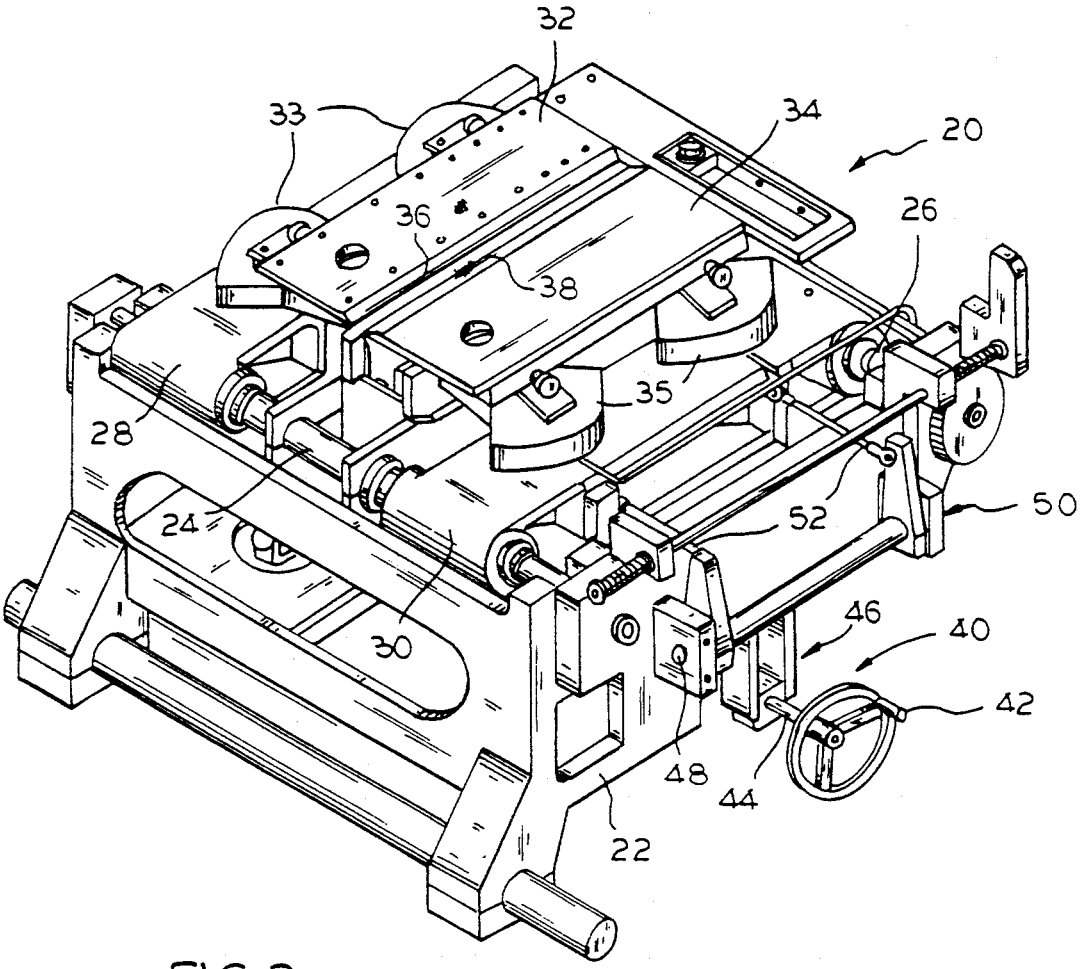
FIG. 2 (PRIOR ART)
FIG. 2 is perspective view of a prior art cover breaker.

Referring to FIG. 2, a prior art cover breaker 20 is illustrated. The cover breaker 20 is operable to form the creases 12 and 14 in the cover C, see FIG. 1. The cover breaker 20 may be a Binder Cover Breaker such as manufactured by Harris, model number UB.

The cover breaker 20 includes a frame 22 having parallel slide rods 24 and 26 extending thereacross. Slideably mounted on the rods 24 and 26 are first and second carriages 28 and 30. A first breaker plate 32 is movably coupled to the first carriage via rotational, pie-shaped flywheels 33. A second movable breaker plate 34 is movably coupled to the second carriage 30 via similar rotational, pie-shaped flywheels 35. The plates 32 and 34 include inner breaker edges 36 and 38, respectively. The plates 32 and 34 are planer with one another and are reciprocally movable relative to one another. Specifically, as is well known, when it is desired to form the crease lines in a cover C, rotation of the flywheels 33 and 35 causes the plates 32 and 34 to reciprocate towards one another to break the cover C as by the breaker edges 36 and 38 applying pressure to the book 10 and cover C to form a sharp square fold on each side 16 and 18.

Figure 3:
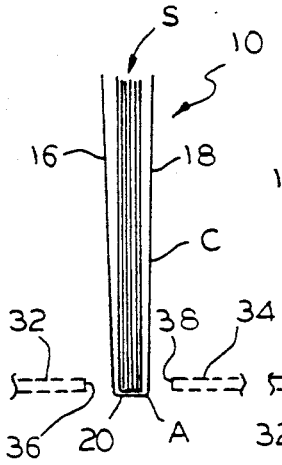
FIG. 3 illustrates in generalized form a book positioned between the plates of the cover breaker in a neutral position.

Referring to FIG. 3, there is shown a gathering of signatures G having a layer of adhesive A applied along the backbone edges thereof. A cover sheet C is wrapped around the gathering of signatures G with a mid-portion, i.e., the inner side of the eventual backbone 20, being in contact with the adhesive layer A. This covered gathering of signatures is positioned, with the backbone 20 down, between the plates 32 and 34 which are in a neutral position, as illustrated in dashed lines. Particularly, in the neutral position, the breaker edges 36 and 38 are spaced apart a distance greater than the thickness of the covered gathering of signatures G.

Figure 4:
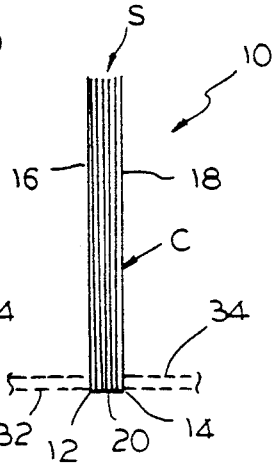
FIG. 4 illustrates in generalized form a book positioned between the plates of the cover breaker in an actuated position.

Referring to FIG. 4, and with the book 10 in the above-described position at the cover breaker 20, the plates 32 and 34 are reciprocally moved a fixed distance toward one another until the breaker edges 36 and 38 are spaced apart a distance equal to the thickness of the book 10. As a result, the edges 36 and 38 cause the crease lines 12 and 14 to be formed in the cover C. The plates 32 and 34 are then moved away from one another to the neutral position for the subsequent operating cycle.

The movement of the plates 32 and 34 relative to their respective carriages 28 and 30, is controlled by a cover breaker drive shaft, not shown, as is well known and which is not part of the invention. Specifically, the cover breaker 20 operates in a cyclical manner. The drive shaft rotates continually, which rotation drives the flywheels 33 and 35. The plates 32 and 34 are continually, reciprocally moved relative to one another between the neutral position, see FIG. 3, and the actuated position, see FIG. 4, by the respective associated flywheels 33 and 35, to perform the cover breaking operation.

As discussed above, the plates 32 and 34 are moved a fixed distance from the neutral position, see FIG. 3, to the actuated position, see FIG. 4. A manually operable control 40 is provided for varying the relative spacing between the plates 32 and 34 in the neutral position according to desired thickness for a book 10. The control 40 includes a hand operated crank 42 fixedly connected to a shaft 44. The shaft 44 is threadably coupled to a pivotal link 46 which is pivotally connected at connection points 48 and 50. A pair of arms 52 connect the link 46, above the pivotal points 48 and 50, to the second carriage 30. Accordingly, rotational movement of the crank 42 is converted to pivotal movement of the link 46 resulting in linear movement of the second carriage 30. Thus, rotating the crank 42 varies the position of the second plate 34 relative to the first plate 32 in the neutral position.

As discussed above, the plates 32 and 34 are moved a fixed distance in the breaking action. Therefore, in order to compensate for different thickness books, the relative positioning of the plates 32 and 34 must be adjusted in the neutral position so that when the plates 32 and 34 are in the actuated position they are spaced a distance apart according to the book thickness. Illustratively, if the book thickness is one inch and the fixed relative movement between the neutral position and the actuated position is one inch, then in the neutral position the plate edges 36 and 38 must be spaced apart two inches. If a book to be bound is only one-half inch thick, then the spacing in the neutral position must be one and one-half inches. Resultantly, with the prior art cover breaker 20, the hand crank 42 is manually operated to manually vary the relative position of the plates 32 and 34 in the neutral position according to the desired spacing in the actuated position.

In automated flat gathering systems, it is desirable to customize the selection of signatures S provided in each book 10 according to the recipient's needs or desires. Resultantly, the number or thickness of signatures S in successive books 10 may be different. Thus the total thickness, in each successive book may be different. The prior art cover breaker 20 would not be useful in such an automated system wherein it is required to continually vary the relative position between the plates 32 and 34 without shutting down the bindery line.

Figure 5:
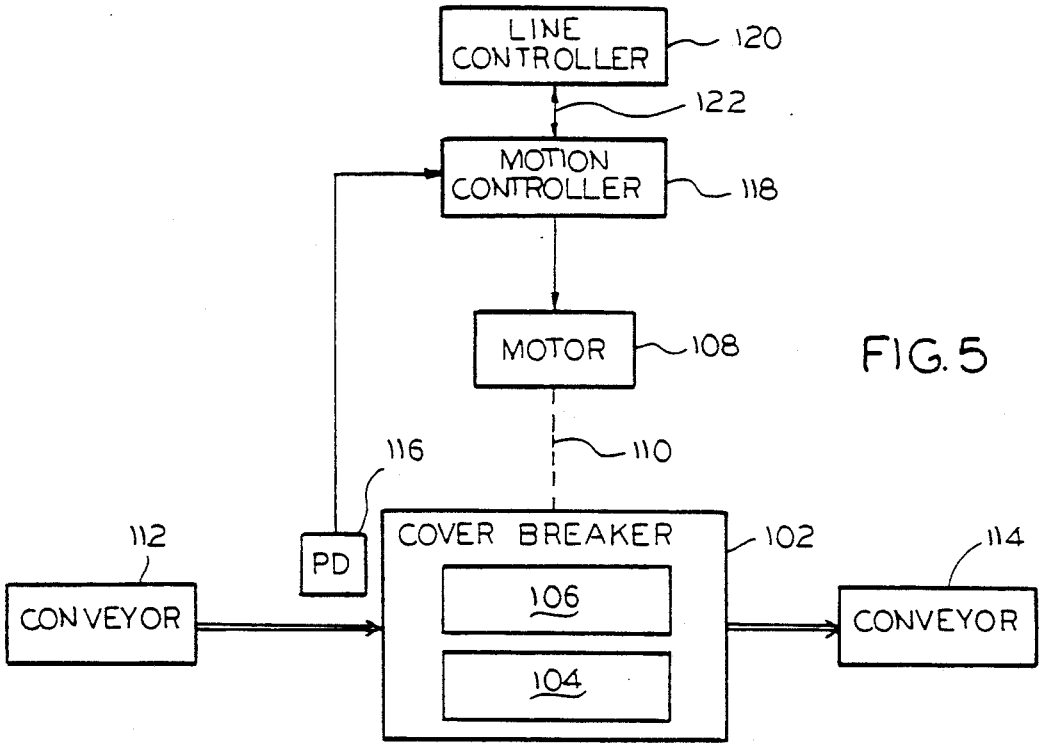
FIG. 5 is a block diagram of a cover breaker control system according to the invention.

Referring to FIG. 5, there is illustrated a block diagram of a cover breaker control system 100 according to the invention which is operable to automatically vary the relative position of the plates 32 and 34.

The control system 100 includes a cover breaker 102 having a first movable plate 104 and a second movable plate 106. The cover breaker 102 is generally similar to the cover breaker 20, see FIG. 2, with the plates 104 and 106 corresponding to the plates 32 and 34. The cover breaker 102 differs from cover breaker 20 in that the hand operated crank 42 is replaced with a motor 108 having a drive, indicated generally by a line 110, mechanically linked to the second plate 106, as discussed below. As above, the motor 108 is operable to control the drive 110 to vary the relative position, i.e. spacing, between the first and second breaker plates 104 and 106 in the neutral position. Since reciprocal movement is a fixed distance, operation of the motor also is effective to vary the spacing in the actuated position.

The cover breaker 102 is positioned between a feed conveyor 112 and a delivering conveyor 114. The feed conveyor 112 includes conventional systems for providing the gathered stack, applying the adhesive layer A, and positioning the unfolded cover C about the gathering of signatures G prior to positioning it between the plates 104 and 106. The conveyor 114 receives the book after the folds have been formed in the cover and delivers it to trimming and stacking devices.

A proximity detector 116 senses the position of one of the flywheels 33 or 35, see FIG. 2. Specifically, the proximity detector 116 generates a detect signal when the flywheels are at a known operational position representing the part of a cycle where books are entering or leaving the cover breaker and are not in contact with the plates 104 and 106. At such time the relative position of the plates 104 and 106 may be varied for the next book. The proximity detector 116 is coupled to a motion controller 118 which is also coupled to the motor 108. The motion controller 118 is also connected to a line controller 120. The connection between the motion controller 118 and the line controller 120 is a bidirectional communication link, such as an RS232 serial transmission link 122.

The line controller 120 may comprise a central processing unit and associated memory and peripheral devices, not shown, which provide for overall supervisory control of the bindery line, including the cover breaker 102. Specifically, the line controller memory stores information relating to the signatures to be selected for each book, and therefore also stores information relating to the thickness of the book.

The motion controller 118 may be, for example, a model 320 Programmable Motion Controller as manufactured by Camco Corporation. The motion controller 118 is a microprocessor based control device which receives information from the line controller 120 relative to the thickness of the book. Also, the motion controller 118 receives velocity and acceleration and deceleration profile information from the line controller 120 according to the distance which the plate 106 is to be be moved. Responsive to these instructions, the motion controller 118 energizes the motor 108 sufficient to move the second plate 106 a desired distance and direction.

Figure 6:
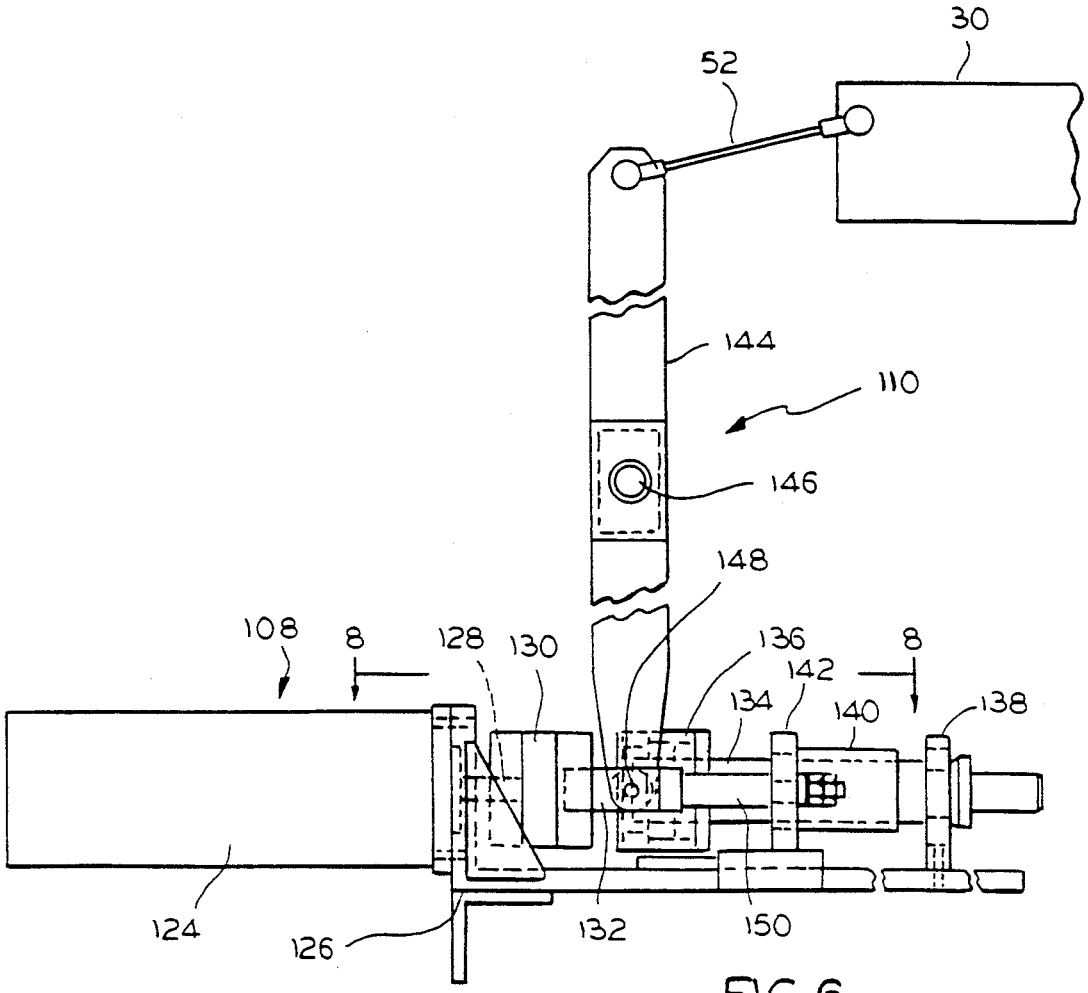
FIG. 6 is a side elevational view, with parts removed for clarity, of the cover breaker drive according to the invention.
Figure 7:
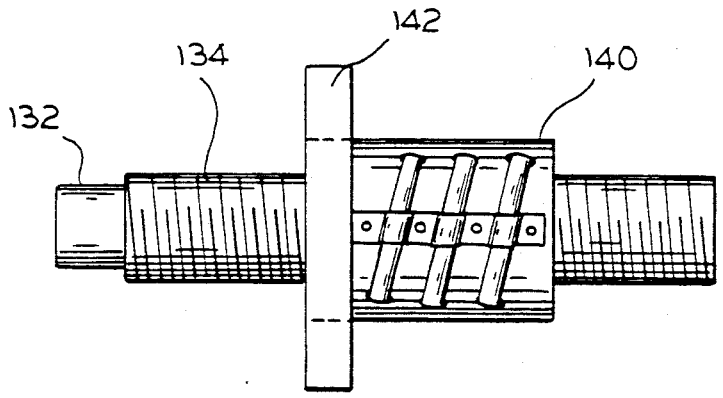
FIG. 7 is a detailed view of a ball bearing screw of the cover breaker drive of FIG. 6.
Figure 8:
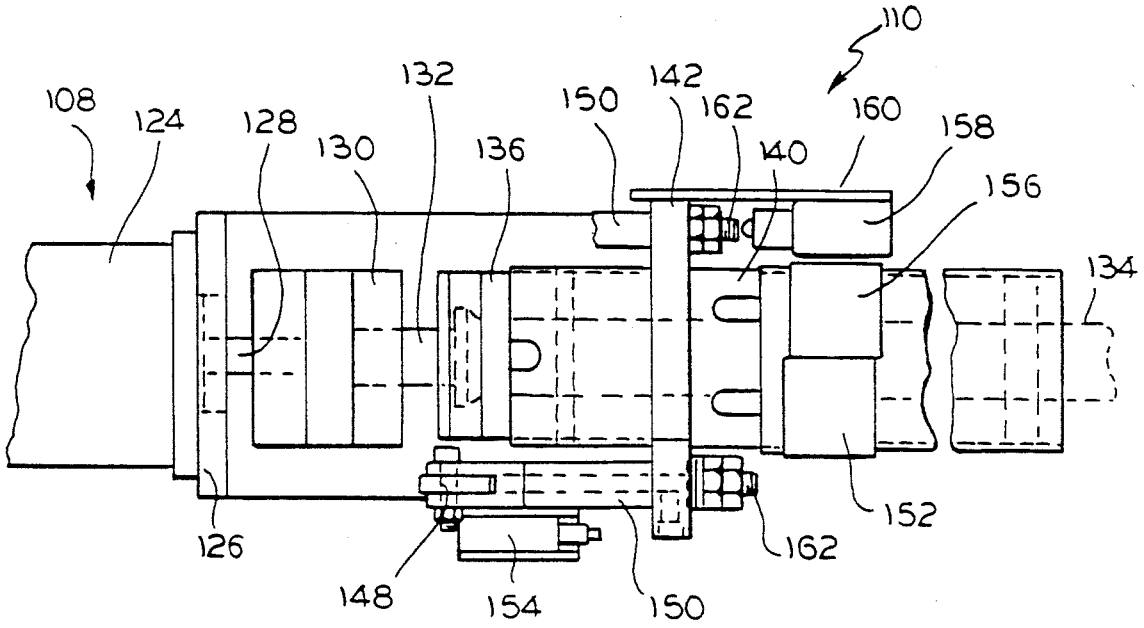
FIG. 8 is a plan view, with parts removed for clarity, of the drive of FIG. 6.

With reference to FIGS. 6–8, the drive 110 is illustrated in greater detail.

The drive 110 may be retrofit to an existing cover breaker, such as the cover breaker 20 illustrated in FIG. 2. In such a retrofit application, the link 46 and mannually operable control 40 are removed and replaced by the drive 110 described herein.

The motor 108 includes a housing 124 fixed to a frame 126. The frame 126 may be secured to the cover breaker frame 22, see FIG. 2, in any known manner. The motor 108 includes an output shaft 128 which is rotatable responsive to commands received from the motion controller 118, see FIG. 5. Fixably coupled to the end of the shaft 128 is a coupling unit 130, such as, for example, a Schmidt SFP-30 coupling unit. Coupled at the opposite side of the coupling unit 130 is a machined end 132 of a lead screw 134. The lead screw 134 is supported in journal bearings 136 and 138. The journals 136 and 138 are fixedly attached to the frame 196.

Threadably mounted on the lead screw 134 is a ball bearing screw 140 having a flange 142. The lead screw 134 and ball bearing screw 140 may comprise, for example, a model RP-1504, part no. 8115-448-012, ball bearing screw assembly manufactured by Warner Electric Brake and Clutch Company.

The preloaded, double nut ball bearing screw 140 is operable to convert rotary motion of the motor shaft 128, and thus lead screw 134, into linear motion of the flange 142. The ball bearing screw 134 provides minimal backlash to provide more accurate control.

The drive unit 110 includes a pivotal link 144, similar to the link 46 of FIG. 2. The link 144 is pivotal about a connection point 146 and is connected to the arms 52 which connect to the second carriage 30. The link 144 is connected by a pair of torque nuts 148 to opposite springs 150 which are bolted to the flange 142. The spring 150 may be, for example, a Danly spring, no. 9-1210-26.

In operation, energizing the motor 108 causes a corresponding rotational movement of the motor shaft 128 thereby rotating the lead screw 132 through the coupler 130. Rotation of the lead screw 132 causes the ball bearing screw 140 to move linearly in a direction determined by the direction of rotation of the lead screw 132. Linear movement of the ball bearing screw 140 causes the flange 142 and thus the springs 150 to move linearly therewith. Resultantly, owing to the connection between the link 144 and the springs 150, linear movement of the springs 150 cause pivotal movement of the link 144 about its connection point 146 to provide movement of the second carriage 30 on its slide rods 24 and 26, as discussed above.

For safety of operation, and with specific reference to FIG. 8, the drive 110 is provided with a home position limit switch 152, an in travel limit switch 154, an out travel limit switch 156 and a thick book limit switch 158. Each of the first three mentioned limit switches 152, 154 and 156 are fastened in any known manner to the frame 126 and are operable to sense selected positions of the flange 142. Particularly, the home position limit switch 152 is operable to sense a position of the flange 142 which represents a start or home position of the cover breaker. The out travel limit switch 158 senses if the flange 142 moves beyond the home position The in travel limit switch 154 senses if the flange 142 has moved to a position whereby the plates 134 and 136 are too close together. In this instance, if a breaking action occurs, then the plates may contact one another and cause damage.

The thick book limit switch 158 is linked to the flange 142 and is operable to sense if a book positioned in the cover breaker is thicker than the expected thickness. Particularly, when the breaking action occurs, if the book is too thick, then an outwardly directed force is applied to the plates 34 and 36 by the book. This force results in a limited movement of the link 144. However, the flange 142 is fixed since the motor 108 is deenergized. Therefore, the springs 150 compress. A bolt 162 which extends through one of the springs 150 is moved with the compression of the spring to contact the limit switch 158 to cause actuation of the same.

Each of the limit switches 152–158 may be coupled to either the motion controller 118 or the line controller 120 and are utilized in conjunction with the cover breaking control program to provide safe operation thereof. For example, if a book is too thick, as determined by the limit switch 158, then it may be necessary or desirable to shut down the entire line as this may be an indication that the books are out of sequence.

Figure 9:
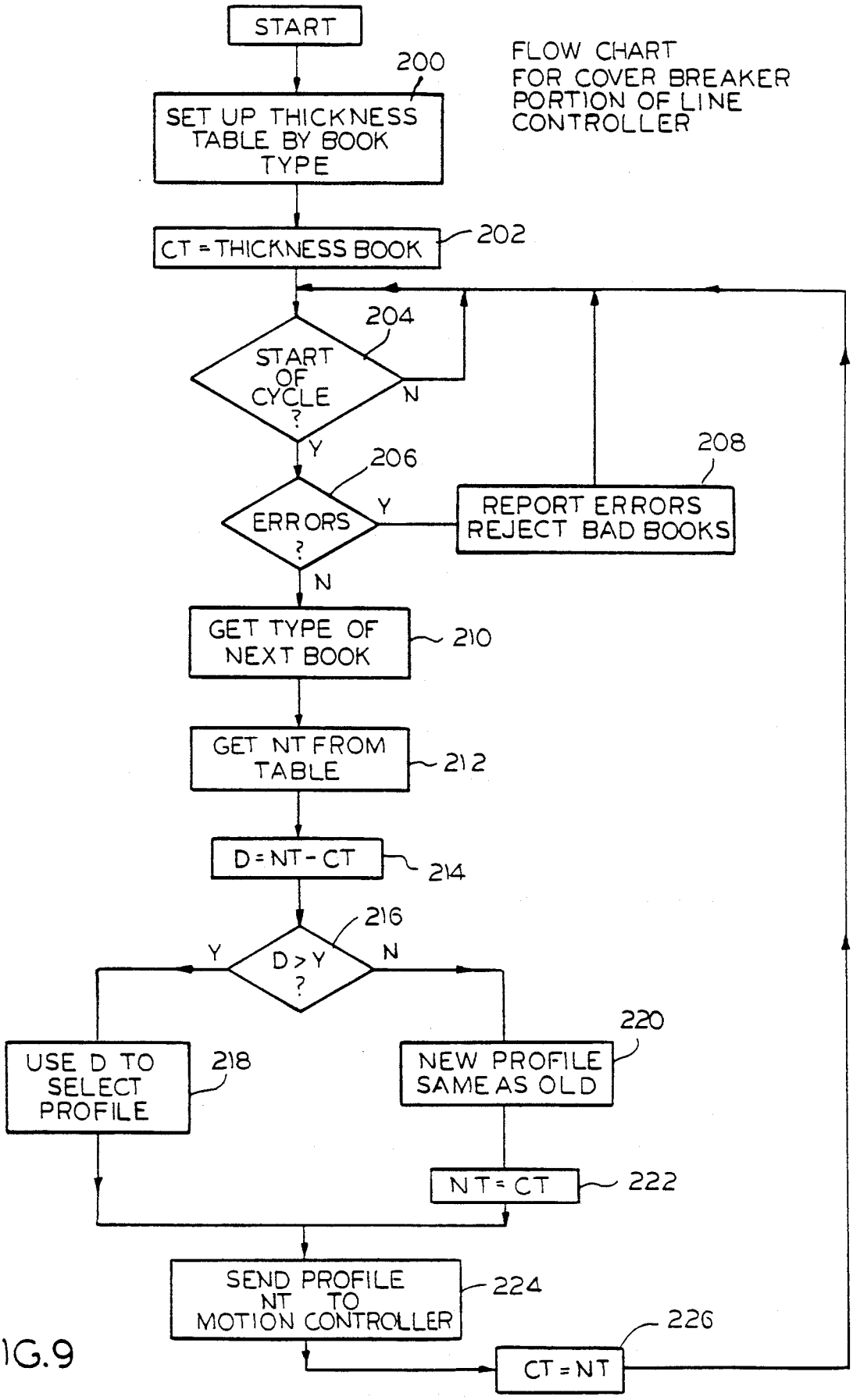
FIG. 9 is a flow chart illustrating the operation of a program for the line controller of FIG. 5.

With reference to FIG. 9, a flow diagram illustrates the operation of a program in the line controller 120 for varying the relative position of the plates 104 and 106. Although the line controller 120 controls the overall bindery process only that portion of the program which relates to the cover breaker operation is discussed herein.

Control begins at a block 200 which sets up a thickness table in memory according to each type of book which will be processed on the bindery line. At a block 202 a value CT is set equal to a preselected value representing the thickest book for which the cover breaker 102 can be set. The parameter CT represents the current thickness which the cover breaker 102 is to be set for. This value represents the spacing between the plates 104 and 106 in the neutral position less the amount of fixed movement provided in the breaking action, as discussed above.

A decision block 204 determines if control is at the start of a cycle. Particularly, one revolution of the drive shaft represents one cycle. If control is at the start of a cycle, then a decision block 206 determines if there have been any errors relative to the processing of the prior book. If so, then the errors are reported at a block 208 and the bad books are rejected and control returns to the block 204. If no errors have been sensed, then at a block 210 the control accesses information relating to the type of book for the next book in the bindery sequence. As is well known, the line controller 120 follows the operation of each book through the bindery and therefore has a record of the type of book as it approaches the cover breaker. At a block 212 the program gets the thickness of the next book from the table set up at the block 200. This thickness is stored as a parameter NT representing the thickness of the next book in the sequence.

At a block 214 a parameter D is calculated by subtracting the current thickness parameter CT from the next thickness parameter NT to determine the distance to be moved by the cover breaker. Illustratively, if the system is currently set for a 1 ½ inch book, i.e. CT=1.5, and the thickness for the next book in the sequence is 1 inch, i.e. NT=1, then D=−0.5. The plus or minus sign indicates the direction to be moved, while the actual number indicates the distance to be moved to provide the proper breaking of the cover.

At a decision block 216 the program determines if the value D is greater than a preselected minimum value Y. For example, according to the controllability of the drive 110, if the desired distance is too small, then such movement may not be controlled reliably. Therefore, it is desirable to maintain the cover breaker in the present position. If the parameter D is greater Y, then at a block 218 the control selects a profile according to the value of D. The profile includes velocity and acceleration and deceleration parameters which are stored in a lookup table which are used by the motion controller 118 to control operation of the motor 108 according to the distance to be moved.

If the value D is not greater than Y, as determined at the decision block 216, then the new profile is set to be the same as the previous profile at a block 220. Thereafter, the parameter NT is set equal to the parameter CT at a block 222. Resultantly, the next thickness value is set equal to the current thickness value, so that no movement will be commanded. From either the block 218 or the block 222, the control is operable at a block 224 to send the profile information and the parameter NT to the motion controller 118. This information will be used by the motion controller 118 during a subsequent cycle of operation to vary the relative positioning, if necessary, between the plates 102 and 104. Finally, at a block 226, the current thickness value is updated to be equal to the parameter NT representing the thickness which the cover breaker spacing will be adjusted to. Thereafter, control returns to the block 204 to wait for the next operational cycle.

Figure 10:
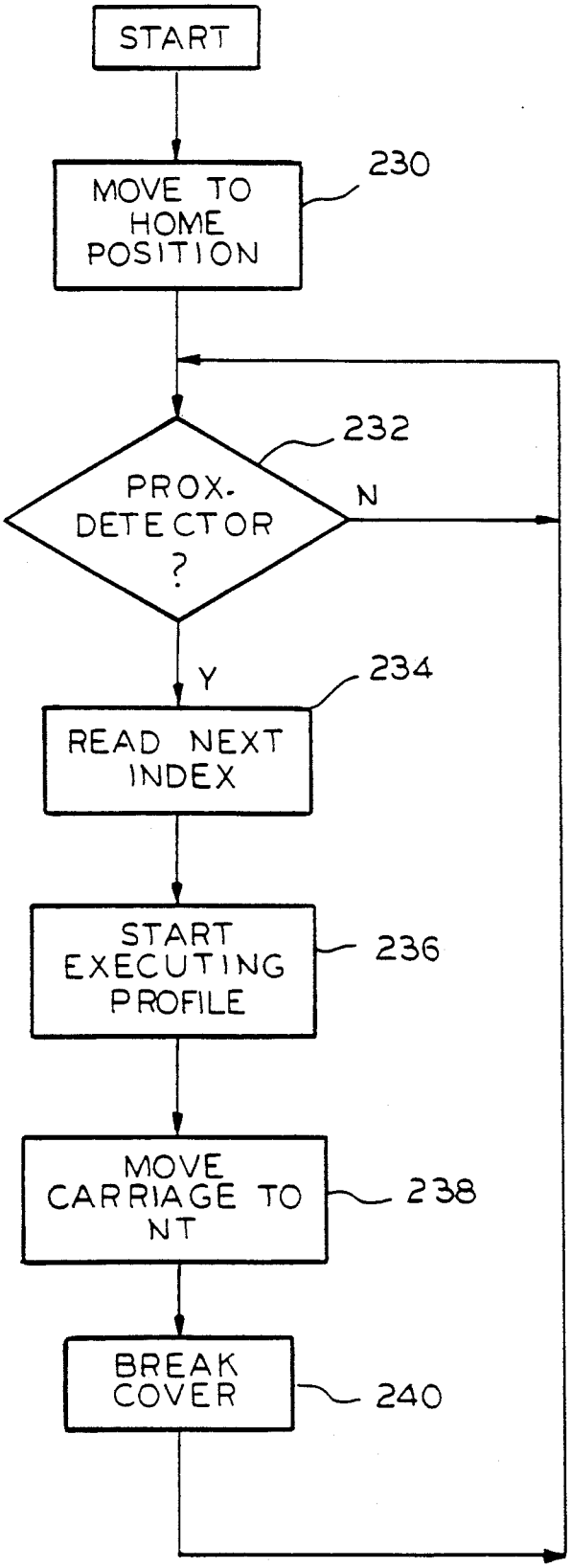
FIG. 10 is a flow chart illustrating the operation of a program for the motion controller of FIG. 5.

With reference to FIG. 10, a flow diagram illustrates the operation of a program stored in the motion controller 118.

The motion controller operation begins at a block 30 which moves the cover breaker to the home position. The home position is determined by the actuation of the home position limit switch 152. Thereafter, control waits at a decision block 232 for the proximity detector 116 to be actuated. As discussed above, the proximity detector 116 is actuated when the flywheels 33 and 35 are in a preselected cycle position indicating that the relative position of the plates 104 and 106 can be updated for the next book in the sequence. In fact, control waits at the decision block 232 until the proximity detector is actuated.

The motion controller 118 includes a buffer for storing the profile data and the NT parameters as they are received from the line controller 120. In an exemplary embodiment, the motion controller 118 includes three index storage locations. Each index is used to store the profile data and the NT parameter for one book. For each operational cycle, the motion controller increments to the next index to obtain the profile data and NT parameter. Consequently, when the line controller 120 sends this information to the motion controller at the block 224, see FIG. 9, it sends the information to the index having the oldest information. Thus, the line controller 120 and motion controller 118 can operate much more quickly without the necessity of waiting for the information to be received during each operational cycle.

Once the proximity detector is actuated, then the motion controller 118 is operable to read the next index at a block 234. Thereafter, at a block 236 the motion controller 118 starts executing the profile utilizing the velocity and acceleration and deceleration information, and moves the carriage to the appropriate position according to the NT parameter at a block 238. With the position of the cover breaker having been so varied, the cover is broken in the normal manner, as discussed above, at a block 240, and control returns to the decision block 232.

Summarizing the operation of the control system, the line controller 120 controls the overall operation according to the sequence of books in the bindery. As each book approaches the cover breaker, the line controller 120 determines the distance which the cover breaker must move for such book and transfers profile information and the thickness value to the motion controller for each such book. Each time a preselected point of the cycle is sensed by the proximity detector 116, the motion controller 118, if necessary, varies the relative positioning between the plates 104 and 106 based on the thickness of the next book as determined by the line controller 120, and the current thickness which the cover breaker 102 is set for. If the position must be varied, then the motion controller 118 operates the motor 108 to implement such movement.

The synchronization between the line controller 120 and the motion controller 118 is obtained by the operation of the drive shaft. Particularly, each cycle of the cover breaker program of FIG. 9 begins at the start of the cycle which is determined by the drive shaft position. Similarly, the position of the cover breaker flywheels 33 and 35 is determined by the drive shaft. The motion controller program operation for each cycle begins according to the position of the flywheels as detected by the proximity detector 116.

Although the control system 100 described herein is operable to vary the positioning of one of the plates according to the thickness of the book, such a system could be modified to move both plates 104 and 106 in varying the relative position. Similarly, such a system could be modified to provide automatically variable distance movement between the neutral position and the actuated position, following the principles of the instant invention described herein, as will be obvious to those skilled in the art.

Thus, the invention broadly comprehends a cover breaker control system which provides for automatically varying the relative position between a pair of cover breaker plates.

We claim:

1. In an automated book binding system operable is a continuous cyclical operation to bind a square-end book cover to a plurality of stacked pages and including a cover breaker having first and second breaker plates movable relative to one another between a neutral position and an actuated position to crease the cover about the stacked pages delivered successively thereto, wherein the number of stacked pages of each successive plurality of stacked pages may be of a distinct quantity to provide a distinct, select book thickness, a control system comprising:

actuator means coupled to one of said plates for varying the relative position of said plates;

first means for determining the actual relative position of said plates;

second means for determining a desired relative position of said plates according to a select thickness for a next successive book; and control means coupled to said actuator means and operable responsive to said first and second determining means after delivery of one plurality of stacked pages for automatically operating said actuator means prior to delivery of a next successive plurality of stacked pages to vary the relative position of said plates according to the actual relative position and the desired relative position to crease the cover of the next successive plurality of stacked pages according to the select thickness.

2. The control system of claim 1 wherein said actuator means comprises a motor.

3. The control system of claim 2 wherein said actuator means further comprises means for converting rotary movement of a motor output shaft to linear movement of said plate.

4. The control system of claim 1 wherein said control means includes means for commanding said actuator means to vary the relative position of said plates according to the difference between the actual relative position and the desired relative position.

5. The control system of claim 4 wherein said control means further includes means for varying the relative position of said plates only if the difference between the actual relative position and the desired relative position is greater than a preselected minimum difference amount.

6. In an automated flat gathering book binding system operable in a continuous cyclical operation to bind a cover to the backbone of a gathered plurality of signatures and including a cover breaker having first and second plates movable a fixed distance relative to one another between a neutral position and an actuated position to crease the cover about the gathered signatures delivered successively thereto, wherein the number of each successive plurality of gathered signatures may be of a distinct quantity to provide a distinct, select book thickness, a cover breaker control system comprising:

a motor having a rotatable output shaft;

coupling means coupling said motor output shaft to one of said plates for varying the relative position of said plates responsive to movement of said shaft;

sensing means for sensing a preselected operational position of said plates;

first means for determining the actual relative position of said plates in the actuated position;

second means for determining a desired relative position of said plates in the actuated position according to a select thickness for a next successive book; and control means coupled to said motor and operable responsive to said sensing means and said first and second determining means after delivery of one plurality of gathered signatures for controlling said motor to rotate said shaft prior to delivery of a next successive plurality of gathered signatures to automatically vary the relative position of said plates according to the actual relative position and the desired relative position when said cover breaker plates are at said preselected operational position to crease the cover of the next successive plurality of gathered signatures according to the select thickness.

7. The control system of claim 6 wherein said actuator means further comprises means for converting rotary movement of a motor output shaft to linear movement of said plate.

8. The control system of claim 6 wherein said control means includes means for commanding said actuator means to vary the relative position of said plates according to the difference between the actual relative position and the desired relative position.

9. The control system of claim 8 wherein said control means further includes means for varying the relative position of said plates only if the difference between the actual relative position and the desired relative position is greater than a preselected minimum difference amount.

10. The method of binding a cover to the backbone of a gathered plurality of signatures comprising the steps of:

successively positioning a cover about a gathering of signatures in a continuous cyclical operation wherein each successive gathering of signatures may be of a distinct, select thickness;

delivering during each cycle of operation one of said gathering of signatures with a cover positioned thereon to a cover breaker having first and second breaker plates movable relative to one another between a neutral position and an actuated position to crease the cover about the pages;

determining the actual relative position of said plates;

determining a desired relative position of said plates according to a select thickness for the next successive book;

automatically controlling an actuator means after delivery of one gathered plurality of signatures for varying the relative position of the plates prior to delivery of a next successive gathered plurality of signatures to vary the relative position of the plates according to the actual relative position and the desired relative position to crease the cover of the next successive gathered plurality of signatures according to the select thickness; and controlling operation of said cover breaker first and second breaker plates to move the same between the neutral position and the actuated position to crease the cover about the pages.

11. The method of claim 10 further comprising the step of commanding the actuator means to vary the relative position of the plates according to a difference between the actual relative position and the desired relative position.

12. The method of claim 11 further comprising the step of varying the relative position of the plates only if the difference between the actual relative position and the desired relative position is greater than a preselected minimum difference amount.

* * * * *